United States Patent [19]

Thorsbakken

[11] Patent Number: 4,553,678

[45] Date of Patent: Nov. 19, 1985

[54] TAMPER INDICATING CONTAINER SAFETY COVER

[76] Inventor: Arden L. Thorsbakken, 931 Richard Dr., Apartment 9, Eau Claire, Wis. 54701

[21] Appl. No.: 623,033

[22] Filed: Jun. 21, 1984

[51] Int. Cl.[4] ..... B65D 55/02

[52] U.S. Cl. ..... 215/218; 215/203

[58] Field of Search ..... 215/203, 201, 214, 216, 215/218, 217, 220, 253, 256

[56] References Cited

U.S. PATENT DOCUMENTS

| | | | |
|---|---|---|---|
| 3,944,102 | 3/1976 | Grau | 215/251 |
| 3,950,917 | 4/1976 | Choksi et al. | 53/3 |
| 3,952,899 | 4/1976 | Cooke | 215/217 |
| 3,963,139 | 6/1976 | Gach | 215/216 |
| 4,020,965 | 5/1977 | Northup | 215/213 |
| 4,084,716 | 4/1978 | Bogert | 215/217 |
| 4,209,101 | 6/1980 | Brown | 215/253 |

*Primary Examiner*—George T. Hall
*Attorney, Agent, or Firm*—Kinney & Lange

[57] ABSTRACT

A safety cap assembly for bottles is of the type which permits unscrewing only when the cap is axially depressed and rotated to unscrew it, thereby disengaging a locking mechanism from a container thread abutment. This "push to turn" requirement makes the cap difficult for a child to remove. When the cap is rotated to unscrew it, a tamper film is marked or scored which mark is clearly visible through a clear area of the cap or through an aperture to indicate tampering. In addition, the locking mechanism is arranged to permit removal of elements which render the locking mechanism inoperative. This permits the cap to be used in a normal manner by persons that may have arthritis or other crippling diseases. Further, the cap may be utilized as a tamper indicating means alone without the child resistant feature for edible foodstuffs and liquids.

12 Claims, 16 Drawing Figures

Fig.1
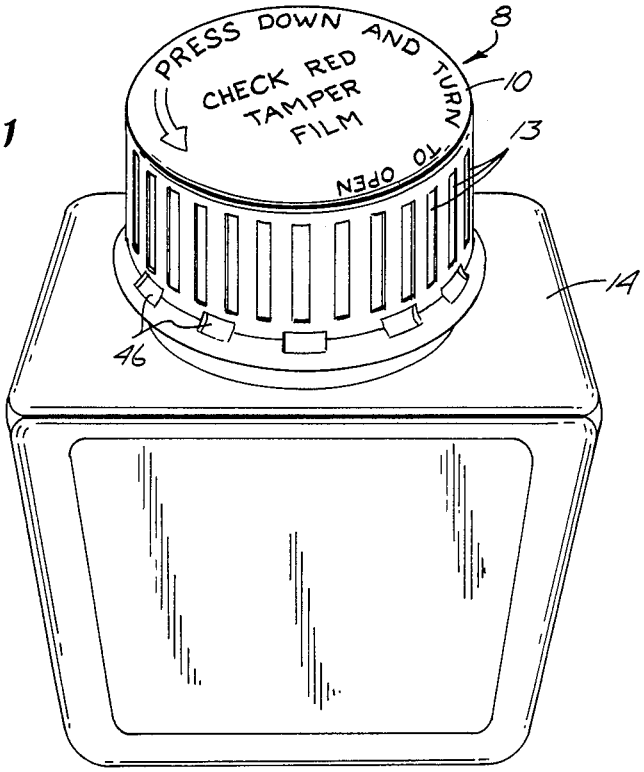
Fig.2
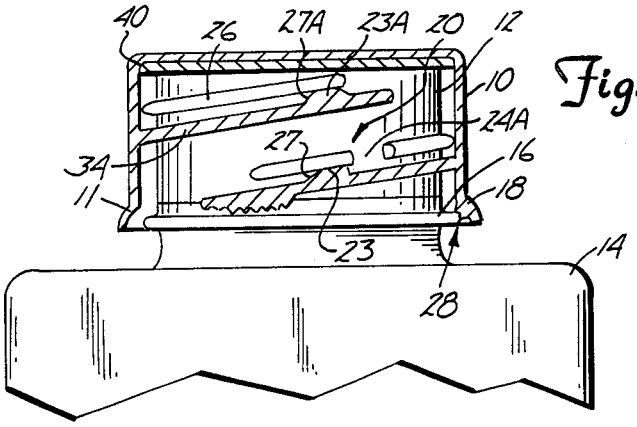
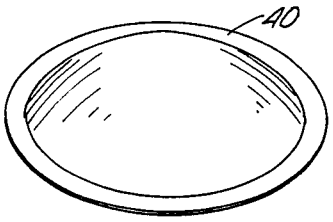
Fig.3
Fig.4
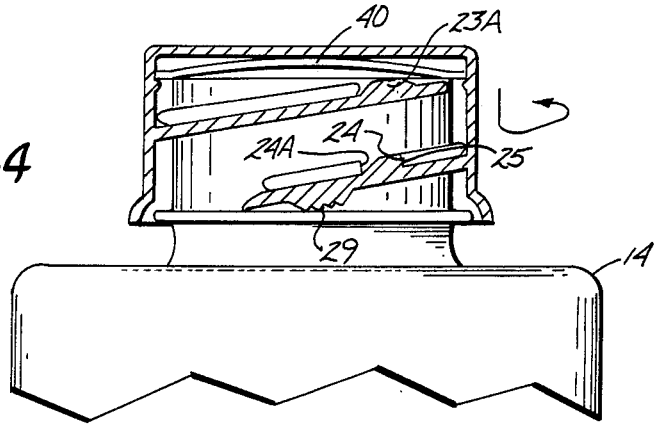

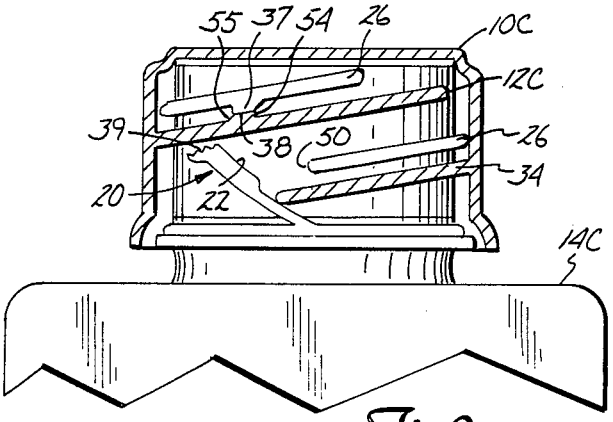
Fig.9
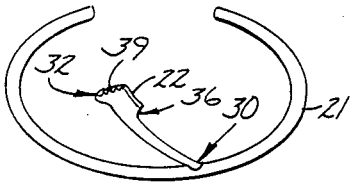
Fig.10
Fig.12
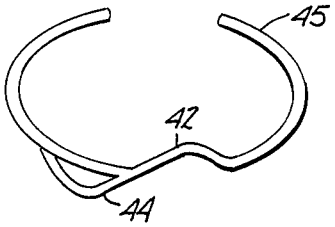
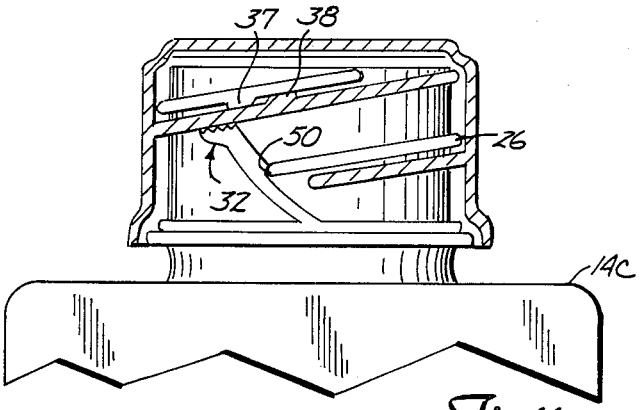
Fig.11
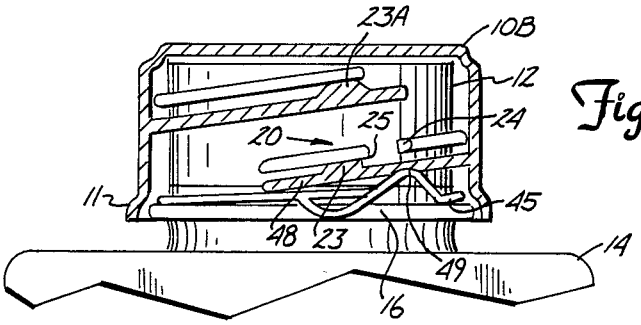
Fig.13
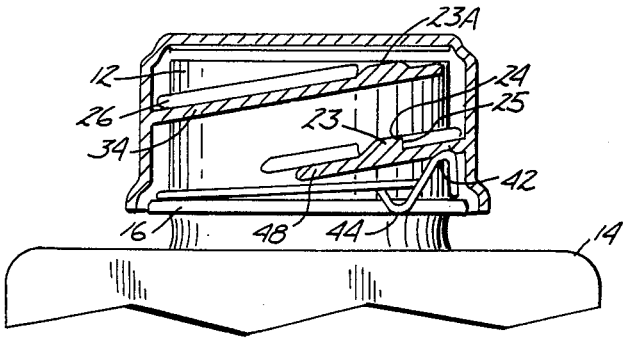
Fig.14

TAMPER INDICATING CONTAINER SAFETY COVER

BACKGROUND OF THE INVENTION

1. Field of the Invention.

The present invention relates to tamper indicating screw-on caps for containers with threaded necks, which caps may also be child resistant, but wherein the push to turn element can be removed when not needed to permit use by persons that may have arthritis or other crippling diseases, or commercial uses where the child resistant feature are not necessary as for food stuffs and beverages, but where tamper indicating is still desired.

2. Description of the Prior Art.

Child proof and tamper resistant caps have been shown in the prior art. A typical example of a child resistant closure is shown in U.S. Pat. No. 3,944,102 which has an inner screw cap, and an outer drive member or cap fitting over the inner screw cap which is latched in place securely. A spring member is provided between the inner and outer caps, which moves the two caps to a position where they do not engage to permit driving the inner cap to loosen the cap. Upon depressing the outer cap, however, the two members will be drivably engaged to permit unscrewing the inner screw cap. An indicating member is used for indicating initial unscrewing of the closure from the container to indicate that the original seal has been broken.

U.S. Pat. No. 4,020,965 shows another child resistant closure which has a square periphery on the outer drive cap, and has springs between the outer drive cap and the inner screw cap for a selective engagement of driving lugs for unscrewing the inner screw cap.

U.S. Pat. No. 4,209,101 shows a tamper proof closure that has an inner cap and an outer cap, which have a tamper proof indicating member to show relative movement, including a tearaway tab that must be removed before the cap can be opened.

U.S. Pat. No. 3,963,139 is a tamper proof indicating cap that has a single cover and there is a cooperating neck on the container. The assembly initially is tamper indicative and continues to be child resistant no matter how many times it is used. It essentially comprises a pair of toothed elements that engage when the cap is tightened and resists loosening movement.

U.S. Pat. No. 3,950,917 illustrates a multiple part container cap which has an outer ring which has to be moved to engage relative driving members for removal of the cap. The assembly also includes a seal that must be broken when the cap is used, and which will indicate that the members have been moved.

SUMMARY OF THE INVENTION

The present invention relates to tamper indicating caps for screw-type containers having a screw threaded neck which also may be child resistant. The cap is manufactured from clear plastic (with see through properties) or from plastic or metal with see through apertures that disclose a tamper indicating film or foil on the container neck, threads or top. This film or foil is visible through the clear material or the apertures upon external examination. The present invention as shown comprises an internally screw threaded cap with a lock mechanism member moved by said cap into engagement with an abutment surface on the container thread to prevent the cap from being removed unless the cap is simultaneously depressed and rotated to unscrew it.

The lock mechanism may be disabled to permit the cap to be freely unscrewed from the container so that persons having difficulty using the child resistant caps and do not have young children in the home may convert to a cap that is easily removable.

A tamper indicating film may be fixed with respect to the container neck. An inwardly projecting marking mechanism on the cap, or on a part that moves with the cap, engages the tamper indicating film to create a mark thereon when the cap means is rotated to unscrew it from the container neck.

These safety caps are relatively inexpensive to make, are safe in that they remain child resistant as long as the lock means is not removed, but yet will permit persons having arthritis or other disabling diseases to convert the cap into a freely removable screw cap.

BRIEF DESCRIPTION OF THE DRAWINGS

FIG. 1 is a perspective view of a first embodiment of the safety cap of the present invention tightened onto a screw type container;

FIG. 2 is a side view of the safety cap and upper portion of the container of FIG. 1 with portions of the cap broken away to show the screw thread arrangement;

FIG. 3 is a perspective view of a biasing spring used with the safety cap of the present invention;

FIG. 4 is a view similar to FIG. 2 with the safety cap partially unscrewed showing the cap locked from further removal;

FIG. 9 is a side view of an upper portion of a container in a fourth preferred embodiment of the safety cap and lock mechanism with the cap fully tightened into position and with portions of safety cap broken away to show the thread and locking arrangement;

FIG. 10 is a perspective view of a lock mechanism used in the fourth preferred embodiment;

FIG. 11 is a view similar to that of FIG. 9 with the cap slightly unscrewed to its locking position;

FIG. 12 is a perspective view of a third preferred embodiment of the safety cap spring bias mechanism used with the cap embodiments shown in FIGS. 1–8;

FIG. 13 is a side view of the upper portion of a container and cap of the third preferred embodiment using the spring bias mechanism of FIG. 12 showing the cap fully tightened onto the bottle with portions of the cap broken away;

FIG. 14 is a view of the device of FIG. 13 with the cap partially unscrewed showing the bias mechanism of FIG. 12 biasing the cap into a locking mode;

DETAILED DESCRIPTION OF THE PREFERRED EMBODIMENTS

Figure 5:
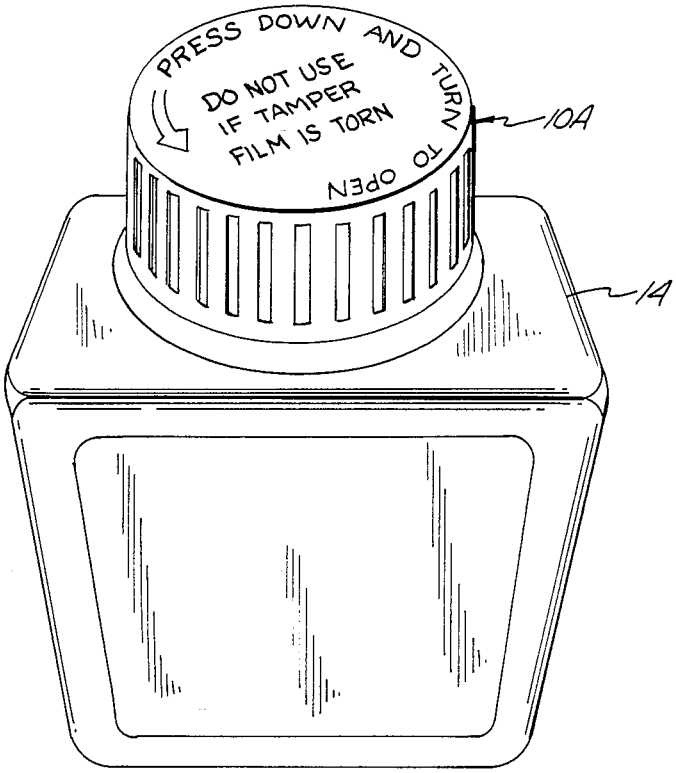
FIG. 5 is a perspective view of the safety cap of a second embodiment of the present invention fully tightened onto a screw type container.

The first embodiment of the tamper indicating safety cap of the present invention is generally shown as 8 in FIG. 1. As shown in FIGS. 1 and 2, safety cap 8 comprises an inverted cup-shaped cap 10 with external gripping recesses 13, and internal screw threads 34 dimensioned to mate with external container threads 26 on the neck 12 of a container 14. Cap 10 further defines a skirt 11 disposed about the open end of cap 10 to extend over the container neck base and a lug or flange 18 projecting inward from the inner wall of skirt 11. When cap 10 is fully tightened, flange 18 engages a tamper indicating material 16 disposed about base ledge 28 of neck 12, and when the cap 10 is unscrewed the flange 18 will visibly mark or tear the material 16 to indicate relative movement between the cap 10 and the container 14.

Cap 10 may be made of any material such as plastic or metal. However, for indicating film 16 to be visible, suitable portions of the skirt 11 have to be clear or, if opaque, apertures 46 as shown in FIG. 1, are provided in the skirt 11 of cap 10 so that the tamper indicating material 16 is visible therethrough by a user.

Indicating material 16 is preferably a film, foil or paint disposed along the base of container neck 12. As an example, two layers of film may be tacked to the base of container neck 12, the inner or lower layer being of a different color than the outer or upper layer. Upon engagement of flange 18 with the top layer of the film 16, the top (outer) layer is ruptured, exposing the different colored lower (inner) layer. If paint is used it should be nontoxic and would comprise the outer layer. The inner layer would then be the surface of the bottle which would be exposed when the paint is scored.

As shown in FIGS. 2 and 4, a locking mechanism 20 comprises protrusions or cam locking lug formed on the lower portion of cap threads 34. Protrusion 23 has inclined on cam surface 27 which causes the protrusion to move under the container threads 26 upon rotation of cap 10 to screw it onto container neck 12. The protrusion 23 has a locking end surface 25 which will engage an abutment surface 24 of container thread 26 upon reverse rotation of cap 10 to unscrew it. A second protrusion 23A is formed near the upper end of the cap thread and has a cam surface 27A, and lug 23A will act to cam or force the cap 10 toward the container 14 during the last few degrees of turning the cap 10 to tighten it. Upon reverse movement, the lug 23A will clear the end of the container threads to permit the cap 10 to move upwardly so lug 23 will be permitted to move to locking position.

A detachable bias spring 40, acting in opposition to axial movement of cap 10 toward the container 14 is compressed as the cap 10 is tightened and causes the lock mechanism 20 to be operable as the cap 10 is unscrewed. FIG. 2 indicates the position of bias spring 40 when cap 10 is fully tightened into position, and FIG. 4 indicates the position of spring 40 when cap 10 is partially unscrewed. In FIG. 4, lug 23A has moved away from the end of the container threads permitting the cap to move upwardly so that protrusion or lock lug 23 moves into a clearance recess 24A formed by removal of a short section of the container threads 26. The locking end surface 25 engages thread abutment surface 24, preventing cap 10 from being further unscrewed. If the cap is to be unscrewed, it can be depressed, that is pushed toward the container, until the surface 25 clears abutment surface 24 and while being held depressed the cap 10 can be twisted enough to move locking end surface 25 past abutment surface 24. The spring 40 can be removed so the locking mechanism 20 will be rendered inoperative, allowing cap 10 to be used in a normal manner.

As disclosed by FIGS. 2 and 4, cap 10 may further comprise a downward projecting and preferably serrated protrusion 29 extending from cap threads 34. When indicating film 16 is disposed around the base of container neck 12, protrusion 29 engages and marks or scores indicating film 16 upon rotation of cap 10 to unscrew it. Serrations on protrusion 29 may be unidirectional, so that when the cap is tightened down after initial filling the indicating film will not be marked but when cap 10 is rotated to unscrew it the protrusion 29 will score or mark indicating film 16. This means for scoring indicating film 16 may be used in addition to or in the alternative with the inward projecting flange 18. The bias spring 40 may have a tab or loop thereon for easy removal if the child resistant feature is not desired.

Indicating film 16 may be disposed on the upper edge of the open end of container neck 12 or on the inner surface of the closed end of cap 10. If positioned on the upper edge of the neck 12, upon rotation of cap 10 to unscrew it, bias spring 40 is rotated and since it is in engagement with indicating film 16 it will cause a mark to be made on film 16. Cap 10 should then have a transparent closed end so that the mark created on indicating film 16 is visible therethrough. When tamper indicating film 16 is disposed on the container neck 12 open end, bias spring 40 should also be composed of transparent material. Again, this tamper indicating means may be used in addition to or in the alternative with inward projecting flange 18.

Figure 6:
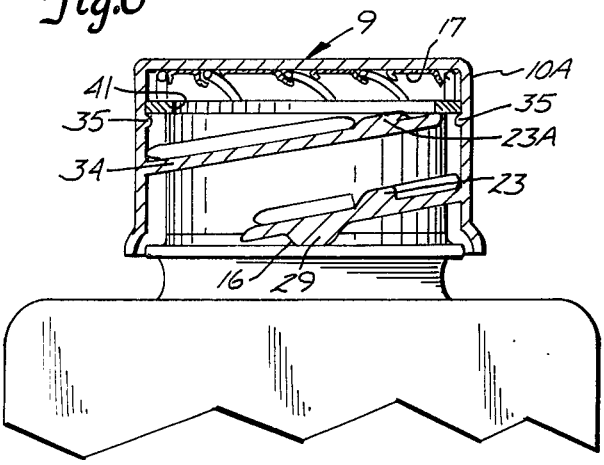
FIG. 6 is a side view of the safety cap and upper portion of the container in a locking mode with portions of the cap broken away to show the screw thread arrangement.
Figure 7:
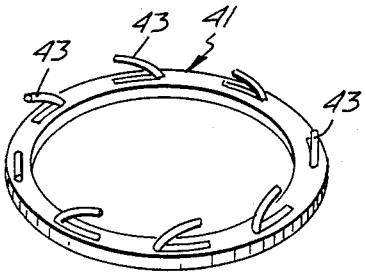
FIG. 7 is a perspective view of the safety cap biasing spring used in the second embodiment of the invention.
Figure 8:
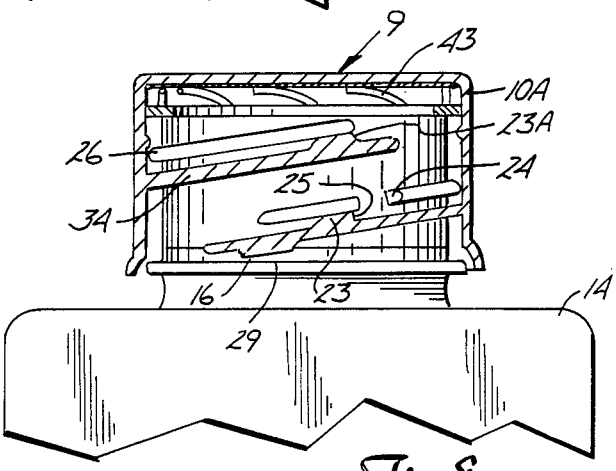
FIG. 8 is a view similar to that of FIG. 6 but with the safety cap when fully tightened onto the container neck.

FIGS. 5–8 further disclose a second preferred embodiment of the safety cap. Cap 10A of FIGS. 5–8 includes protrusions 23 and 23A projecting from cap threads 34, substantially identical to cap 10 of FIGS. 1–4. However, bias spring 41, as shown in FIG. 7, is a different form of spring than bias spring 40 utilized in the first preferred embodiment. Bias spring 41 is an annular open center ring of diameter comparable to the external diameter of the container neck 12, and has resilient fingers 43 projecting therefrom. Fingers 43 may be formed by partially punching them out of the ring and raising up the sections of ring 41 or by integrally molding projecting fingers 43 as a part of ring 41.

Similar to the first preferred embodiment, cap 10A further comprises a layer of indicating material 17 adhered to the inside surface of closed end 9 of cap 10A for engagement with fingers 43 of bias spring 41. As shown in FIG. 6, rotation of cap 10A to unscrew it will cause fingers 43 of bias spring 41 to engage and rupture or score indicating film 17. Again, at least a portion of closed end 9 of cap 10A should be molded with a transparent material so that the scoring of indicating film 17 by bias spring 41 will be clearly visible.

Cap 10A may also comprise indicating material 16 disposed at the base of container neck 12 for engagement with serrated protrusion 29 upon rotation of cap 10A to unscrew, substantially similar to the arrangement of the first preferred embodiment.

Bias spring 41 may be retained at the closed end 9 of cap 10A as a separate and removable element, or may be detachably retained at the closed end 9 of cap 10A by an internal ledge or lip 35 as indicated in FIG. 6. As in the first preferred embodiment, removal of spring 41 allows cap 10A to be used in a normal non-child resistant manner.

A third preferred embodiment of the safety cap is indicated in FIGS. 12–14. Cap 10B of FIGS. 13 and 14 comprises a locking mechanism 20 substantially similar to that of the first and second preferred embodiments. When the cap 10B is rotated to unscrew it, surface 25 of protrusion 23 is rotated into engagement with the container thread abutment surface 24. Another variation of the bias mechanism is utilized by the third preferred embodiment. As shown by FIG. 12, bias spring 45 is disposed around the base of neck 12 prior to cap 10B being threaded onto said neck 12.

As seen in FIG. 12, bias mechanism 45 includes both a spring loop 42 providing the axial bias to the cap 10B, and a detachment loop 44 which allows one to use a screwdriver or similar instrument to pry bias mechanism 45 off of container neck 12. Detachment loop 44 may also be used to engage an indicating film disposed around the base of container neck 12, in a manner similar to serrated protrusion 29 of the first embodiment. As is seen in FIGS. 13 and 14, lead cap thread 48 may be notched or grooved, such as groove 49 of FIGS. 13 and 14, so that spring loop 42 will engage groove 49. This engagement will cause ring 45 to rotate with cap 10B drawing deatachment loop 44 across indicating film 16 upon rotation of cap 10B to unscrew it. Unidirectional serrations may be provided to the bottom of attachment loop 44 so that the film is scored only upon rotation to unscrew the cap 10B. As in the first and second preferred embodiments, removal of the bias mechanism 45 allows cap 10B to be used in a normal manner.

Figure 15:
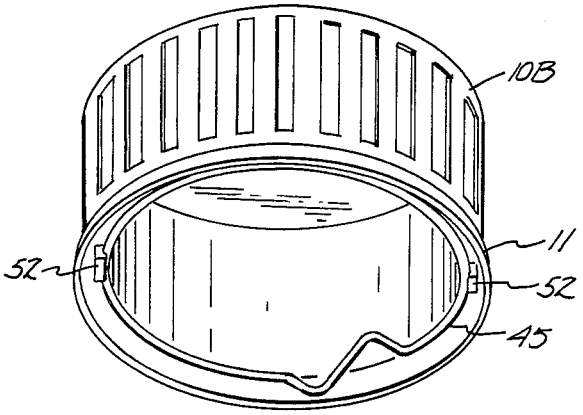
FIG. 15 is a bottom perspective view of a cap assembly having a spring biasing mechanism similar to that shown in FIG. 12 integrally molded as a part of the cap.
Figure 16:
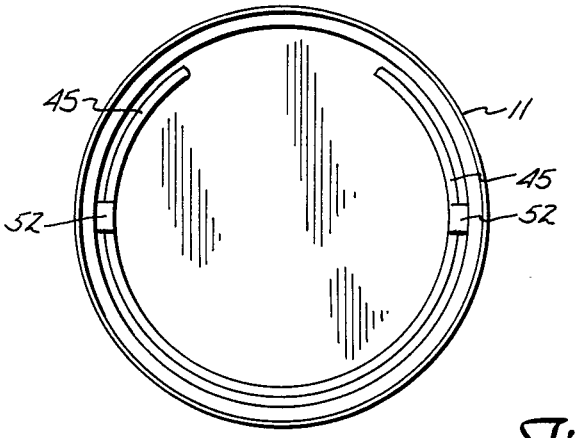
FIG. 16 is a bottom plan of the cap assembly of FIGS. 13 and 14 having the spring biasing mechanism of FIG. 12 integrally molded as a part of the cap.

As seen in FIGS. 15 and 16, the bias spring 45 of FIG. 12 may also be integrally molded at the opened end of cap 10B. This will result in reducing the overall molding costs (as opposed to separate molding of the parts) and to simplify products filling and capping machinery. Bias spring 45 is retained at the opened end of cap 10B by frangible fingers 52 such that bias spring 45 will fracture off when the cap is first tightened down and will be left on the bottle unless the user elects to remove it to allow the cap 10B to be used in a normal manner.

On prescription bottles, that is bottles used for dispensing prescriptions, it is not necessary for the bottle to be tamper indicating.

The safety caps of the first, second and third preferred embodiment may be used with containers having several individual sections of external thread removed to create a plurality of container thread abutment surfaces around the container neck 12 if desired for enhanced child resistance.

A fourth preferred embodiment of the safety cap of the present invention is disclosed in FIGS. 9–11. Cap 10C comprises internal threads 34 dimensioned to mate with external container threads 26 and 26C on the neck 12C of a container 14C.

Lock mechanism 20 includes a detachable and rotatable C-shape ring member 21 of comparable diameter to the external diameter of container neck 12C around which it is disposed. Lock mechanism 20 further comprises resilient arm member 22 joined to ring 21 at a first end shown at 30 in FIG. 10. Arm member 22 extends at an acute angle from the plane of ring 21 and has an second or outer end 32 which is biased upwardly so it will engage cap theads 34 as the cap 10C is unscrewed. Arm 22 has a notch 36 formed between said first end 30 and second end 32. Cap threads 34 have a cam 38 which will engage a cam 37 on the container threads 26C as the final tightening of the cap 10C occurs to force the cap 10C down toward the container 14C. In this position the inner or lower end of cap threads 34 bears on arm 22 to move second end 32 downwardly away from the upper portion of the cap 10C threads 34, as shown in FIG. 9. As soon as the cap 10C is unscrewed slightly the cams 37 and 38 clear each other and arm 22 will move upwardly so second end 32 engages the threads of the cap 10C as shown in FIG. 11.

As cap 10C is first rotated to unscrew it, the ring 21 also rotates and notch 36 of arm 22 will be moved along with the cap 10C into engagement with the lower end of the container thread 26 forming an abutment surface 50, preventing cap 10C from being further unscrewed from container neck 12C. Axial depression of cap 10C moves notch 36 below the abutment surface 50 of the container thread 26. When cap 10C is rotated to unscrew from this depressed position, engagement of the arm second end 32 with cap thread 34 rotates arm 22 below and past the abutment surface 50 of the container thread 26 to force second end 32 down to disengage it from the container thread abutment surface 50 so that cap 10C can be unscrewed from container neck 12C.

Ring 21 may be integrally molded at the open end of cap 10C or fastened over the base of container neck 12C prior to cap 10C being threaded onto container neck 12C. Ring 21 may further comprise a detachment loop similar to loop 44 of ring 45 in the third preferred embodiment so that ring 21 may be removed with greater ease. As is seen in FIG. 10, arm 22 may also be formed with wedge shaped gripping fingers 39 or other suitable engaging means on its second end 32.

As shown in FIG. 9, the cams 37 and 38 have inclined edges 54 and 55, respectively. Edge 54 is arranged to contact and be directed along the container thread 26C when cap 10C is rotated to screw cap 10C onto container neck 12C. Edge 55 is arranged to contact and be directed along cap 10C threads 34 when cap 10C is rotated to screw it onto container neck 12C. The engagement of cams 37 and 38 forces cap 10C axially downward.

Cap 10C may also be constructed with internal stress lines which will cause the cap to fracture if an attempt is made to pry the cap 10C off rather than to remove it by the required push-to-turn method.

There is nothing to prevent use of this tamper indicating invention for packaging of soft drinks and food stuffs where a child resistant feature is not needed. In such case, cap 10 could be manufactured with apertures or see through material in the skirt area and can have internal unidirectional markers to engage and score a painted surface or film on the base of bottle threads. If a paint (nontoxic) is used as an indicator, scoring or marking the paint, which comprises the outer layer, to expose the bottle surface, which comprises an inner layer, will provide tamper indication.

It will also be apparent to those skilled in the art that a number of other modifications and changes can be made without departing from the spirit and scope of the present invention. Therefore, it is to be understood that the invention is not to be limited except by the claims which follow.

I claim:

1. A locking safety cap for closing a screw type container having a container thread of a container neck, said safety cap comprising:

cap means having internal screw threads dimensioned to mate with the external container threads, said cap means arranged for rotational movement about and longitudinal movement along the container neck axis; and lock means comprising a removable ring assembly of size to fit within the cap means and having portions which engage portions of a neck of a container as the cap means is tightened down, said ring assembly including at least one resilient projection having an end engageable with a surface of the cap and yielding in axial direction of the neck as the cap is tightened and engaging a surface of the cap to tend to extend axially and resist unscrewing motion of the cap as portions of the ring assembly react forces to portions of a container on which the cap is mounted, said projection being compressible by downward motion of the cap to a release condition and permit unscrewing motion.

2. The apparatus of claim 1 further comprising a tamper indicating means fixed with respect to the container neck and a flange means carried by the cap means into engagement with the indicating means upon rotation of the cap means to unscrew it, for creating a visible mark on the indicating means indicative of relative movement between the cap means and container.

3. The apparatus of claim 2 wherein said cap means has an inverted cup shape defining a closed end and skirted open end.

4. The apparatus of claim 3 wherein said flange means is a transparent inwardly projecting lip disposed about the open end of the cap means.

5. The apparatus of claim 3 wherein said film means is disposed around the base of the container neck and said flange means is a serrated protrusion projecting from the cap threads in the direction of the cap means open end arranged to engage the indicating film means upon rotation of the cap means to unscrew it.

6. The apparatus of claim 10 wherein the bias means is a generally C-shaped spring mechanism having an upward projecting spring member providing axial lift to the cap means and a downward projecting detachment loop providing a grasp for an instrument used to remove the spring from the container neck.

7. The apparatus of claim 3 wherein the indicating means is a frangible film secured around the container neck having a frangible outer layer and colored inner layer, said upper layer arranged to break away upon engagement with the flange means leaving the colored inner layer visible through the flange means.

8. The apparatus of claim 7 wherein the tamper indicating means is disposed at the base of the container neck.

9. The apparatus of claim 1 wherein the ring assembly includes an annular ring disposed about the container neck base and the projection comprises a resilient arm member joined tangentially to the annular ring by a first end, said arm member extending at an acute angle from the plane of said annular ring and engaging a surface of the cap means threads at a second end, said arm member being adapted to be carried into engagement with a container thread abutment surface upon rotation of the cap means to unscrew it, and to be carried below and past the container thread abutment surface upon axial depression and rotation of the cap means to unscrew it.

10. The apparatus of claim 9 wherein said arm member has a notch between said first and second ends for engaging the container thread abutment surface.

11. The apparatus of claim 6 wherein the cap means further comprises cam means projecting from the cap means threads into engagement with the container threads for providing axial movement of the cap means into engagement with the arm member as the cap means is screwed onto the container neck.

12. A tamper indicating safety cap for closing a screw type container having an externally screw threaded neck, an abutment surface of said threads disposed adjacent the base of the container neck, said safety cap comprising:

tamper indicating means fixed with respect to the container neck; and cap means having internal screw threads dimensioned to mate with the external container threads, said cap means further comprising flange means arranged to engage the indicating means upon rotation of the cap means to unscrew it for indicating relative movement between the cap means and container, and lock means comprising a ring member removably mountable on such container neck and having a resilient arm member adapted to engage and be carried with the cap means into engagement with an abutment surface of the container threads upon rotation of the cap means to unscrew it, for preventing the cap means from being removed from the container neck, said arm member further being movable to position wherein it moves below and may be rotated past said container thread abutment surface upon axial depression and rotation of the cap means to unscrew it for facilitating removal of the cap means from the container neck.

* * * * *